US006249930B1

(12) United States Patent
Noggle

(10) Patent No.: US 6,249,930 B1
(45) Date of Patent: Jun. 26, 2001

(54) DUST PAN FOR COLLECTING A MIXTURE OF MATERIALS

(76) Inventor: David D. Noggle, 1250 N. Greenview, Apt. 2, Chicago, IL (US) 60622

( * ) Notice: Subject to any disclaimer, the term of this patent is extended or adjusted under 35 U.S.C. 154(b) by 0 days.

(21) Appl. No.: 09/260,210

(22) Filed: Mar. 1, 1999

(51) Int. Cl.[7] ..... A47L 13/52
(52) U.S. Cl. ..... 15/257.1; 15/257.9
(58) Field of Search ..... 15/257.1, 257.2, 15/257.7, 257.9

(56) References Cited

U.S. PATENT DOCUMENTS

| | | | |
|---|---|---|---|
| D. 57,649 | 4/1921 | Hines . | |
| D. 265,541 | 7/1982 | Messenger et al. . | |
| D. 347,915 | 6/1994 | Berti . | |
| 360,643 * | 4/1887 | Austin | 15/257.2 |
| 531,177 * | 12/1894 | Gere | 15/257.9 |
| 593,299 | 11/1897 | Jeklin . | |
| 2,475,619 * | 7/1949 | Johnson | 15/257.7 |
| 2,666,309 * | 1/1954 | Anderson | 15/257.9 |
| 4,109,338 * | 8/1978 | Mertes | 15/257.2 |
| 4,686,734 | 8/1987 | Kahan . | |
| 5,457,844 * | 10/1995 | Hanna | 15/257.9 |
| 5,826,297 * | 10/1998 | Footer | 15/257.9 |

FOREIGN PATENT DOCUMENTS

| | | | |
|---|---|---|---|
| 946533 * | 1/1964 | (GB) | 15/257.1 |
| 6-7277 * | 1/1994 | (JP) | 15/257.1 |

* cited by examiner

*Primary Examiner*—Randall E. Chin
(74) *Attorney, Agent, or Firm*—Michael R. McKenna

(57) ABSTRACT

A dust pan for collecting a mixture of materials, including liquids, from a flat or contoured surface. This improved dust pan has a flexibly movable bottom wall that conforms to the floor contour and means to reduce liquid spill over.

8 Claims, 2 Drawing Sheets

DUST PAN FOR COLLECTING A MIXTURE OF MATERIALS

BACKGROUND OF THE INVENTION

This invention relates to a dust pan for collecting a mixture of materials from a flat or contoured surface. The preferred embodiments of the invention show an improved dust pan which includes a body member having a recess disposed therein for receiving the mixture, said recess having an entryway comprising a leading contact edge extending from a bottom wall, wherein the improvement comprises the leading contact edge being flexibly movable between a concave aspect relative to said recess when extraneously unbiased and a substantially straight aspect when biased by pressable contact with the flat surface, so that a sealing contact may be made between the leading contact edge of the duct pan and the flat surface to be cleaned to facilitate collection of the mixture of materials from the flat surface.

In another embodiment of the improved dust pan with a body member having a bottom wall with a leading contact edge and a rear trailing portion with a pair of upstanding side walls that extend, respectively, from an end of the leading contact edge, the improvement comprises the bottom wall being flexibly movable between an outwardly concave shape when extraneously unbiased and a substantially flat shape when biased by pressable contact with the flat surface to be cleaned, whereby, a sealing contact may be made between the bottom wall of the duct pan and the flat surface to be cleaned to facilitate collection of the mixture of materials from the flat surface.

The foregoing improvements, as well as others detailed hereinafter, enhance the prior art as shown in U.S. Pat. No. Des. 304,107.

Alternative dust pan technology can be found in U.S. Design Pat. No. 265,541 issued in 1982 to Messenger et.al.; U.S. Pat. No. 57,649 for a sink scraper issued in 1921 to Hines; U.S. Pat. No. 593,299 for a dustpan issued in 1897 to Deklin; and U.S. Design Pat. No. 347,915 issued to Berti in 1994 for a dustpan.

U.S. Pat. No. 4,686,734 issued in 1987 discloses a dustpan having a flexible bottom surface flexibly adapted to conform to the surface being cleaned which, however, does not teach the attachment of such flexible surface to upstanding side walls to protect against lateral disbursement of collected materials. However, this design will not hold liquids.

To alleviate this problem, and others which will become apparent from the disclosure which follows, the present invention conveniently teaches the use of a flexible bottom surface in a dust pan configuration. Such flexible bottom surface is further taught to attach to upstanding side walls which convey pressure forces from the handle and protect against lateral disbursement of collected materials.

Another advantage is having an ergonometric handle uniquely positioned to facilitate contact between the leading edge and the surface to be cleaned which has not been taught or described previously.

These together with other objectives of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

The invention relates to a dust pan for collecting a mixture of materials from a surface to be cleaned comprising a body member having a recess disposed therein for receiving the mixture. The recess has an entryway comprising a leading contact border, a trailing border, and two side edges. Each of the two side edges has a front end connected to an end of the leading contact border and a rear end connected to an end of the trailing border.

The leading contact border comprises a leading contact edge and two leading contact upright edges. Each of the two leading contact upright edges extends from an end of the leading contact edge to the front end of one of the two side edges. The leading contact edge is flexibly movable between a concave aspect relative to the recess when it is extraneously unbiased and a substantially straight aspect when biased by pressable contact with the flat surface. This flexibility allows a sealing contact to be made between the leading contact edge of the dust pan and the flat surface to be cleaned to facilitate collection of the mixture of materials from the flat surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figures 1, 2, 3, 4, 5, 6, 7:
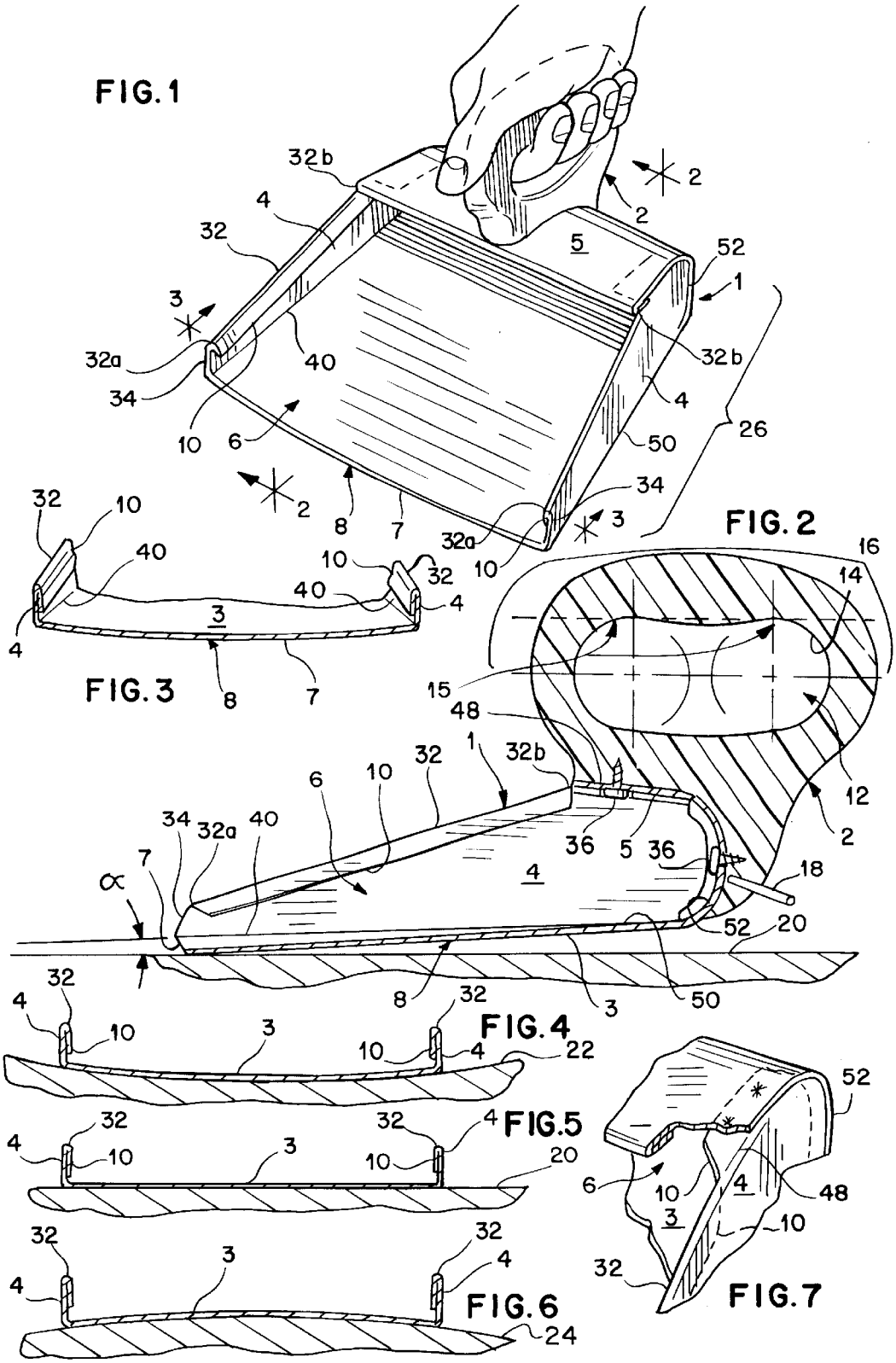
FIG. 1 is a perspective view of a first preferred embodiment of the dust pan for collecting a mixture of material with a users hand engaged to the handle.
FIG. 2 is a cross sectional view taken along the lines 2—2 of FIG. 1 of the instant invention showing the handle having an inner aperture bounded by a rim that has an upper portion forming a hand grip with two sections of the handgrip lying in a generally horizontal plane while each of the pair of flanking edges of the bottom wall has a downward slope to facilitate positioning of the pan for collecting materials from a surface.
FIG. 3 is a partial cut away front perspective view taken along the lines of 3—3 of FIG. 1 of the instant invention showing the concave aspect of the bottom wall and the side wall the reinforcing overlap which strengthens the side wall and aids in conforming the bottom wall to the surface.
FIG. 4 is a cross sectional view taken along the lines of 3—3 of FIG. 1 of the instant invention showing the bottom wall conforming to a concave surface.
FIG. 5 is a cross sectional view taken along the lines of 3—3 of FIG. 1 of the instant invention showing the bottom wall conforming to a flat surface.
FIG. 6 is a cross sectional view taken along the lines of 3—3 of FIG. 1 of the instant invention showing the bottom wall conforming to a convex surface.
FIG. 7 is a detailed partial fragmentary view of the connection between the upstanding side wall and the top portion of the folded over bottom wall of the instant invention showing weld mark locations and the structural positioning of the reinforcing overlap as it connects with the top portion 5.

The preferred embodiments depicted in the drawing include an improved dust pan for collecting a mixture of materials from a flat surface to be cleaned which includes a body member 1 having a recess 6 disposed therein for receiving the mixture, said recess having an entryway comprising a leading contact edge 7 extending from a bottom wall 3, wherein the improvement comprises said leading contact edge 7 is flexibly movable between a concave aspect 8 relative to said recess 6 when extraneously unbiased, as shown in FIG. 3, and a substantially straight aspect when biased by pressable contact with the flat surface, as shown in FIG. 5, whereby, a sealing contact may be made between the leading contact edge of the dust pan and the flat surface to be cleaned to facilitate collection of the mixture of materials from the flat surface 20.

Without departing from the generality of the invention disclosed herein, the improved dust pan for collecting a mixture of materials from a flat surface to be cleaned including a body member 1 having a bottom wall 3 with a leading contact edge 7 and a rear trailing portion 26 with a pair of upstanding side walls 4 that extend, respectively, from an end of the leading contact edge 7, could have the following improvements: comprising the bottom wall 3 being flexibly movable between an outwardly concave shape when extraneously unbiased and a substantially flat shape when biased by pressable contact with the flat surface to be cleaned, whereby, a sealing contact may be made between the bottom wall of the dust pan and the flat surface to be cleaned to facilitate collection of the mixture of materials from the flat surface.

The discussion that follows, without limiting the scope of the invention, will refer to the invention as depicted in the drawing, showing a dust pan for collecting a mixture of materials from a flat or contoured surface to be cleaned comprising a body member 1 having a recess 6 disposed therein for receiving the mixture. The recess has an entryway comprising a leading contact border 28, a trailing border 30, and two side edges 32. Each of the two side edges 32 has a front end 32*a* connected to an end of the leading contact border 28 and a rear end 32*b* connected to an end of the trailing border 30.

The leading contact border 28 comprises a leading contact edge 7 and two leading contact upright edges 34. Each of the two leading contact upright edges 34 extends from an end of the leading contact edge 7 to the front end 32*a* of one of the two side edges. The leading contact edge 7 is flexibly movable between a concave aspect 8 relative to the recess 6 when it is extraneously unbiased and a substantially straight aspect when biased by pressable contact with the flat surface. This flexibility allows a sealing contact to be made between the leading contact edge of the dust pan and the flat surface to be cleaned to facilitate collection of the mixture of materials from the flat surface.

In a preferred embodiment of the dust pan of the present invention, each of the two leading contact upright edges 34 is slightly inclined from vertical, and extends from one of a pair of upright side walls 4. Thus, the pair of upright side walls 4 each has a vertical dimension proximate to the leading contact border 28 sufficient to prevent a substantial portion of the mixture from laterally disbursing.

Preferably, the dust pan further comprises a handle 2 disposed proximate to the trailing border 30. The handle may be pressed in the direction of the trailing border to move the leading contact edge 7 from the concave aspect relative to the recess to a substantially straight aspect as the leading contact edge makes full contact with the flat surface to be cleaned.

Figure 9:
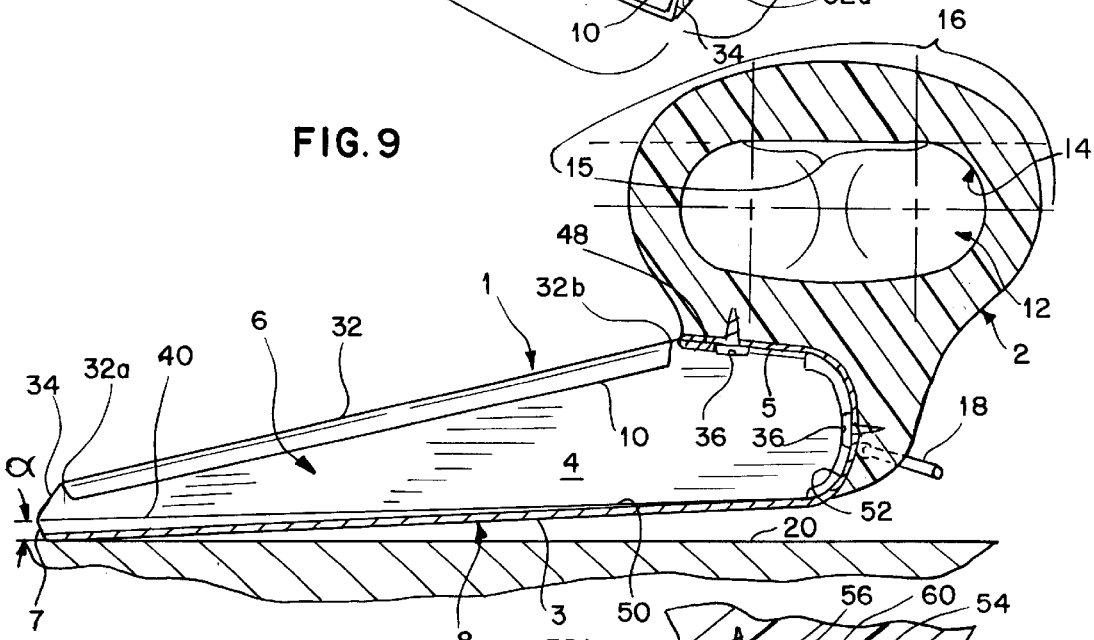
FIG. 9 is a cross sectional view taken along the lines 9—9 of FIG. 8 of the instant invention showing the handle having an inner aperture bounded by a rim that has an upper portion forming a hand grip with one section of the handgrip lying in a generally horizontal plane while each of the pair of flanking edges of the bottom wall has a downward slope to facilitate positioning of the pan for collecting materials from a surface.
Figure 10:
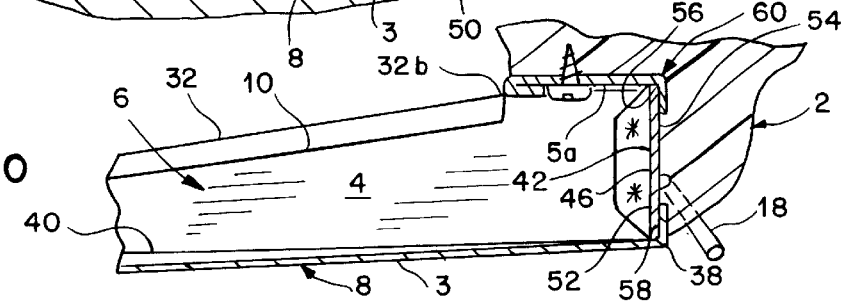
FIG. 10 is a partial cross sectional view taken along the longitudinal centerline of a dust pan of the instant invention showing a distinct bottom wall, rear wall, and top wall in lieu of the folded bottom wall that is shown in FIG. 9.

Moreover, in a preferred embodiment of the dust pan, the two upstanding side edges 4 are parallel. Additionally, the body member 1 may be symmetrical relative to a centerline that is perpendicular to the leading contact edge 7 and the dust pan may further comprise a handle 2 that is disposed along the centerline, as best shown in FIGS. 2, 9, and 10. The handle may also be attached to body member along the centerline.

Figure 8:
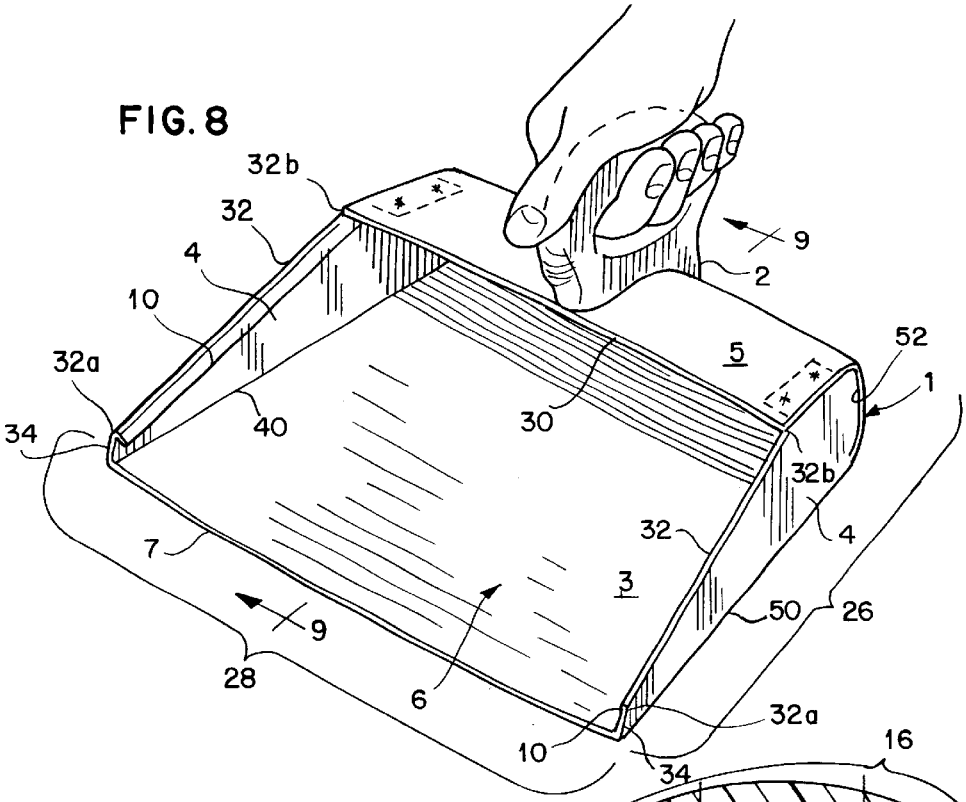
FIG. 8 is a perspective view of a second preferred embodiment of the dust pan for collecting a mixture of material showing a body member with an expanded pan width and length.

Preferably the handle 2 is made out of a rigid plastic and the body member 1 is made out of sheet metal having a thickness of approximately 0.022–0.024 inches for the smaller dust pan shown in FIG. 1 and approximately 0.030–0.034 inches for the larger dust pan shown in FIG. 8. This preferred wall thickness is not any way presented as a limitation, but merely an existing manufacturing parameter. Variances in conforming configurations, sheet metal composition, and method of manufacture will obviously affect thickness properties. Preferably, the walls are interconnected by spot welding or suitable alternative and the handle 2 may easily be attached to body member 1 with screws 36 as shown in FIGS. 2 and 9 of the drawing.

In the preferred embodiments of this invention, the dust pan may also collect a mixture of materials from a contoured surface. The contoured surface may be concave as shown in FIG. 4 or convex as shown in FIG. 6. It comprises a body member 1 having a recess 6 disposed therein for receiving the mixture. The recess has an entryway comprising a leading contact border 28, a trailing border 30, and two side edges 32. Each of the two side edges has a front end 32*a* connected to an end of the leading contact border 28 and a rear end 32*b* connected to an end of the trailing border 30.

The leading contact border 28 comprises a leading contact edge 7 and two leading contact upright edges 34. Each of the two leading contact upright edges extends from an end of the leading contact edge 7 to the front end 32*a* of one of the two side edges 32. The leading contact edge 7 is flexibly movable between a concave aspect relative to the recess when extraneously unbiased and an aspect following the contour of the contoured surface when biased by pressable contact with the contoured surface (collectively, 20, 22, and 24), as shown in FIGS. 4–6. This application of pressure provides a sealing contact between the leading contact edge of the dust pan and the contoured surface to be cleaned to facilitate collection of the mixture of materials from the contoured surface.

Furthermore, a dust pan for collecting a mixture of materials from a flat surface to be cleaned may comprise a bottom wall 3 with a leading contact edge 7, a rear edge 38, and a pair of flanking edges 40, with each of the pair of flanking edges extending from an end of the leading contact edge 7 to an end of the rear edge 38; and a pair of upstanding side walls 4 with each upstanding side wall having a contact leading upright edge 34, a side edge 32, a top edge 48, a bottom edge 50, and a trailing edge 52. It will be readily understood by those skilled in the art that the top edge may be disposed in line with the side edge. Each of the pair of upstanding side walls has the contact leading upright edge 34 extending from an end of the bottom edge 50 to an end of the side edge 32. The other end of the side edge 32 is connected to the top edge 48, the top edge is connected to the trailing edge 52, and the trailing edge is connected to the other end of the bottom edge 50.

Further included is a back wall 54 with a top edge 56, a pair of sideways edges 42, and a bottom edge 58; and a top wall 5*a* with a trailing border 30, a pair of sideways edges 42, and a back edge 60. Each of the pair of lateral edges 46 of the back wall extends between an end of the top edge 56 and a corresponding end of the bottom edge 58, and each of the pair of sideways edges 42 of the top wall extends between an end of the trailing border 30 and a corresponding end of the back edge 60. Each of the pair of upstanding side walls also has its bottom edge 50 connected to one of the pair of flanking edges 40 of the bottom wall, its trailing edge 52 connected to one of the pair of flanking edges 40 of the back wall, and its top edge 48 connected to one of the pair of sideways edges 42 of the top wall. The back edge 60 of the top wall is connected to the top edge 56 of the back wall, and the bottom edge 58 of the back wall is connected to the rear edge 38 of the bottom wall.

A recess 6 for receiving the mixture is also provided, bounded by the top wall 5*a,* the back wall 54, the bottom wall 3 and the pair of upstanding side walls 4. The recess has an entryway comprising the leading contact edge 7 of the bottom wall, the trailing border 30 of the top wall, and the contact leading upright edges 34 and the side edges 32 of the pair of upstanding side walls. The leading contact edge is flexibly movable between a concave aspect relative to the recess when extraneously unbiased and a substantially straight aspect when biased by pressable contact with the flat surface to be cleaned, and a sealing contact may be made between the leading contact edge of the dust pan and the flat surface to be cleaned to facilitate collection of the mixture of materials from the flat surface.

This preferred embodiment of the dust pan of this important invention may further comprise a handle 2 having an inner aperture 12 bounded by a rim 14 with at least two sections 15 along the rim lying in a generally horizontal plane while each of the pair of flanking edges 40 of the bottom wall has a downward slope with the end of the flanking edge disposed proximate to the leading contact edge 7 being lower than the end proximate to the rear edge 38.

Additionally, the handle may have at least a portion thereof connected to the top wall 5*a* proximate to the trailing border 30 and at a spaced distance from the back edge 60.

Preferably, each of the pair of upright side walls 4 has a vertical dimension proximate to the leading contact border 28 sufficient to prevent a substantial portion of the mixture from laterally disbursing. The contact leading upright edge 34 of each of the pair of upright side walls 4 may also have a length that is greater by a predetermined amount than the spaced distance between the its bottom edge 50 and its side edge 32 proximate to the contact leading upright edge, whereby, each of the pair of upright side walls has a vertical dimension proximate to the contact leading upright edge sufficient to prevent the mixture from laterally disbursing. See particularly FIGS. 1, 2, 8, and 9.

A favored feature of the dust pan of the present invention has the back wall curved outwardly providing a concave surface in the recess, whereby, splashing will be reduced when the mixture comprises a liquid.

In another preferred embodiment of the dust pan for collecting a mixture of materials from a flat surface to be cleaned, the dust pan includes a bottom wall 3 with a leading contact edge 7, a trailing border 30, and a pair of flanking edges 40; a pair of upstanding side walls 4, each upstanding side wall has a contact leading upright edge 34, a side edge 32, a top edge 48, a bottom edge 50, and a trailing edge 52.

Each of the pair of flanking edges 40 extends from an end of the leading contact edge to an end of the trailing border, and each of the pair of upstanding side walls has the contact leading upright edge extending from an end of the bottom edge 50 to an end of the side edge 32, the other end of the side edge is connected to the top edge 48, the top edge is connected to the trailing edge 52, and the trailing edge is connected to the other end of the bottom edge 50.

Each of the pair of upstanding side walls has its top edge 48, trailing edge 52 and bottom edge 50 connected to one of the pair of flanking edges 40 of the bottom wall.

Further included is a recess for receiving the mixture bounded by the bottom wall 3 and the pair of upstanding side walls 4. The recess has an entryway comprising the leading contact edge and the trailing border 30 of the bottom wall, and the contact leading upright edges 34 and the side edges of the pair of upstanding side walls.

The leading contact edge 7 is flexibly movable between a concave aspect relative to the recess when extraneously unbiased and a substantially straight aspect when biased by pressable contact with the flat surface to be cleaned. In this way, a sealing contact may be made between the leading contact edge of the dust pan and the flat surface to be cleaned to facilitate collection of the mixture of materials from the flat surface.

In another preferred embodiment of the current invention, a dust pan for collecting a mixture of materials from a contoured surface to be cleaned is disclosed comprising a body member 1 with a bottom wall 3 and a pair of upstanding side walls 4. The bottom wall has a leading contact edge, a trailing border, and a pair of flanking edges. Each of the pair of flanking edges extends from an end of the leading contact edge to an end of the trailing border. Each upstanding side wall 4 has a contact leading upright edge 34, a side edge 32, a top edge 48, a bottom edge 50, and a trailing edge 52.

Each of the pair of upstanding side walls has the contact leading upright edge extending from an end of the bottom edge to an end of the side edge. The other end of the side edge is connected to the top edge. The top edge is connected to the trailing edge, and the trailing edge is connected to the other end of the bottom edge. Each of the pair of upstanding side walls has its top edge 48, trailing edge 52 and bottom edge 50 connected to one of the pair of flanking edges 40 of the bottom wall.

Also provided is a recess for receiving the mixture which is bounded by the bottom wall 3 and the pair of upstanding side walls 4. The recess has an entryway comprising the leading contact edge 7 and the trailing border 30 of the bottom wall, and the contact leading upright edges 34 and the side edges 32 of the pair of upstanding side walls. The leading contact edge is flexibly movable between a concave aspect relative to the recess when extraneously unbiased and an aspect following the contour of the contoured surface when biased by pressable contact with the contoured surface. Thus, a sealing contact may be made between the leading contact edge of the dust pan and the contoured surface to be cleaned to facilitate collection of the mixture of materials from the contoured surface.

In another preferred embodiment of the invention, a dust pan for collecting a mixture of materials from a flat surface to be cleaned comprises a body member 1 with a bottom wall 3, a pair of upstanding side walls 4, a top wall 5*a,* and a back wall 54. The bottom wall has a leading contact edge, a rear edge, and a pair of flanking edges. Each of the pair of flanking edges 40 extends from an end of the leading contact edge 34 to an end of the rear edge 38. The bottom wall is flexibly movable between an outwardly concave shape when extraneously unbiased and a substantially flat shape when biased by pressable contact with the flat surface to be cleaned, so that a sealing contact may be made between the bottom wall of the dust pan and the flat surface to be cleaned to facilitate collection of the mixture of materials from the flat surface.

Each upstanding side wall has a contact leading upright edge, a side edge, a top edge, a bottom edge, and a trailing edge. Each of the pair of upstanding side walls has the contact leading upright edge extending from an end of the bottom edge to an end of the side edge, the other end of the side edge is connected to the top edge, the top edge is connected to the trailing edge, and the trailing edge is connected to the other end of the bottom edge.

The top wall 5*a* has a trailing border 30, a pair of sideways edges 42, and a back edge 56. Each of the pair of sideways edges of the top wall extends between an end of the trailing border and a corresponding end of the back edge. Each of the pair of upstanding side walls has its bottom edge 50 connected to one of the pair of flanking edges 40 of the bottom wall, its trailing edge 52 connected to one of the pair of lateral edges 46 of the back wall, and its top edge 56 connected to one of the pair of sideways edges 42 of the top wall. The back edge of the top wall is connected to the top edge of the back wall, and the bottom edge of the back wall is connected to the rear edge of the bottom wall.

The back wall 54 has a top edge 56, a pair of lateral edges 46, and a bottom edge 58. Each of the pair of lateral edges of the back wall extends between an end of the top edge and a corresponding end of the bottom edge.

In another preferred embodiment of the dust pan for collecting a mixture of materials from a flat surface to be cleaned, a body member 1 is provided with a bottom wall 3, and a pair of upstanding side walls 4.

The bottom wall has a leading contact edge 7, a rear edge 38, and a pair of flanking edges 40. Each of the pair of flanking edges extends from an end of the leading contact edge to an end of the rear edge. The bottom wall is flexibly movable between an outwardly concave shape when extraneously unbiased and a substantially flat shape when biased by pressable contact with the flat surface to be cleaned, so that a sealing contact may be made between the bottom wall of the dust pan and the flat surface to be cleaned to facilitate collection of the mixture of materials from the flat surface.

Each upstanding side wall has a top edge 48, a bottom edge 50, and a trailing edge 52. Each of the pair of upstanding side walls 4 has the top edge extending from an end of the bottom edge to an end of the trailing edge, and the trailing edge is connected to the other end of the bottom edge. Each of the pair of upstanding side walls has its bottom edge connected to one of the pair of side edges of the bottom wall.

Preferably, the body member 1 is symmetrical relative to a centerline that is perpendicular to the leading contact edge 7, and the dust pan further comprises a handle 2 that is disposed along the centerline and attached to body member along the centerline.

Additionally, the dust pan of the current invention may include a handle having an inner aperture 12 bounded by a rim 14 that has an upper portion forming a handgrip 16 with at least a section 15 of said handgrip lying in a generally horizontal plane while each of the pair of flanking edges 40 of the bottom wall has a downward slope with the end of the flanking edge disposed proximate to the leading contact edge 7 is lower than the end proximate to the rear edge 38.

Furthermore, each of the pair of upright side walls 4 may have a vertical dimension proximate to the leading contact border 28 sufficient to prevent the mixture from laterally disbursing. The angle $\alpha$, referred to in FIGS. 2 and 9, is used to illustrate that the flanking edge of the bottom wall has a downward slope relative to the section of the handgrip lying in a generally horizontal plane. Since both the section of the handgrip and the flat floor surface are disposed horizontally, $\alpha$ is shown between the flanking edge and the floor.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

Further, the purpose of the foregoing is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A dust pan for collecting a mixture of materials from a flat surface to be cleaned comprising a body member having a. a bottom wall with a leading contact edge, a rear edge, and a pair of flanking edges, each of the pair of flanking edges extends from an end of the leading contact edge to an end of the rear edge;

b. a pair of upstanding side walls, each upstanding side wall has a contact leading upright edge, a side edge, a top edge, a bottom edge, and a trailing edge, each of the pair of upstanding side walls has the contact leading upright edge extending from an end of the bottom edge to a front end of the side edge, a rear end of the side edge is connected to the top edge, the top edge is connected to the trailing edge, and the trailing edge is connected to the other end of the bottom edge;

c. a back wall with a top edge, a pair of lateral edges, and a bottom edge, each of the pair of lateral edges of the back wall extends between an end of the top edge and a corresponding end of the bottom edge; and d. a top wall with a trailing border, a pair of sideways edges, and a back edge, each of the pair of sideways edges of the top wall extends between an end of the trailing border and a corresponding end of the back edge, each of said pair of upstanding side walls has its bottom edge connected to one of the pair of flanking edges of the bottom wall, its trailing edge connected to one of the pair of lateral edges of the back wall, and its top edge connected to one of the pair of sideways edges of the top wall, the back edge of the top wall is connected to the top edge of the back wall, and the bottom edge of the back wall is connected to the rear edge of the bottom wall;

e. a recess for receiving the mixture is bounded by the top wall, the back wall, the bottom wall and the pair of upstanding side walls, said recess having an entryway comprising the leading contact edge of the bottom wall, the trailing border of the top wall, and the contact leading upright edges and the side edges of the pair of upstanding side walls, said leading contact edge being flexibly movable between a concave aspect relative to said recess when extraneously unbiased and a substantially straight aspect when biased by pressable contact with the flat surface to be cleaned, whereby, a sealing contact may be made between the leading contact edge of the dust pan and the flat surface to be cleaned to facilitate collection of the mixture of materials from the flat surface.

2. The dust pan of claim 1, further comprising a handle having an inner aperture bounded by a rim with at least two sections along said rim lying in a generally horizontal plane while each of the pair of flanking edges of the bottom wall has a downward slope relative to the section of said handgrip lying in a generally horizontal plane with the end of the flanking edge disposed proximate to the leading contact edge being lower than the end proximate to the rear edge.

3. The dust pan of claim 2, wherein each of the pair of upright side walls has a vertical dimension proximate to the leading contact border sufficient to prevent the mixture from laterally disbursing.

4. The dust pan of claim 2, wherein the contact leading upright edge of each of the pair of upright side walls has a length that is greater by a predetermined amount than the spaced distance between the its bottom edge and its side edge proximate to said contact leading upright edge, whereby, each of the pair of upright side walls has a vertical dimension proximate to the contact leading upright edge sufficient to prevent the mixture from laterally disbursing.

5. The dust pan of claim 2, wherein the back wall is curved outwardly providing a concave surface in the recess, whereby, splashing will be reduced when the mixture comprises a liquid.

6. The dust pan of claim 1, further comprising a handle with at least a portion thereof connected to the top wall proximate to the trailing border and at a spaced distance from the back edge.

7. A dust pan for collecting a mixture of materials from a flat surface to be cleaned comprising a body member having a. a bottom wall with a leading contact edge, a rear edge, and a pair of flanking edges, each of the pair of flanking edges extends from an end of the leading contact edge to an end of the rear edge, said bottom wall being flexibly movable between an outwardly concave shape when extraneously unbiased and a substantially flat shape when biased by pressable contact with the flat surface to be cleaned, whereby, a sealing contact may be made between the bottom wall of the dust pan and the flat surface to be cleaned to facilitate collection of the mixture of materials from the flat surface;

b. a pair of upstanding side walls, each upstanding side wall has a contact leading upright edge, a side edge, a top edge, a bottom edge, and a trailing edge, each of the pair of upstanding side walls has the contact leading upright edge extending from an end of the bottom edge to a front end of the side edge, a rear end of the side edge is connected to the top edge, the top edge is connected to the trailing edge, and the trailing edge is connected to the other end of the bottom edge;

c. a back wall with a top edge, a pair of lateral edges, and a bottom edge, each of the pair of lateral edges of the back wall extends between an end of the top edge and a corresponding end of the bottom edge; and d. a top wall with a trailing border, a pair of sideways edges, and a back edge, each of the pair of sideways edges of the top wall extends between an end of the trailing border and a corresponding end of the back edge, each of said pair of upstanding side walls has its bottom edge connected to one of the pair of flanking edges of the bottom wall, its trailing edge connected to one of the pair of lateral edges of the back wall, and its top edge connected to one of the pair of sideways edges of the top wall, the back edge of the top wall is connected to the top edge of the back wall, and the bottom edge of the back wall is connected to the rear edge of the bottom wall.

8. A dust pan for collecting a mixture of materials from a flat surface to be cleaned comprising a body member having a bottom wall with a leading contact edge, a rear edge, and a pair of flanking edges, each of the pair of flanking edges extends from an end of the leading contact edge to an end of the rear edge, said bottom wall being flexibly movable between an outwardly concave shape when extraneously unbiased and a substantially flat shape when biased by pressable contact with the flat surface to be cleaned, whereby, a sealing contact may be made between the bottom wall of the dust pan and the flat surface to be cleaned to facilitate collection of the mixture of materials from the flat surface;

a pair of upstanding side walls, each upstanding side wall has a top edge, a bottom edge, and a trailing edge, each of the pair of upstanding side walls has the top edge extending from an end of the bottom edge to an end of the trailing edge, and the trailing edge is connected to the other end of the bottom edge;

each of said pair of upstanding side walls has its bottom edge connected to one of the pair of flanking edges of the bottom wall; and further comprising a handle having an inner aperture bounded by a rim that has an upper portion forming a handgrip with at least a section of said handgrip lying in a generally horizontal plane while each of the pair of flanking edges of the bottom wall has a downward slope relative to the section of said handgrip lying in a generally horizontal plane with the end of the flanking edge disposed proximate to the leading contact edge being lower than the end of the flanking edge proximate to the rear edge.

* * * * *